US012297653B2

(12) United States Patent
Core et al.

(10) Patent No.: US 12,297,653 B2
(45) Date of Patent: May 13, 2025

(54) COMPACTIBLE INNER FORM ASSEMBLY FOR FORMING CONCRETE BUILDING SHAFTS

(71) Applicant: SEAMILL AUS PTY LTD, Lake Illawarra (AU)

(72) Inventors: Darren Core, Lake Illawarra (AU); Emanuel Braz, Lake Illawarra (AU)

(73) Assignee: SEAMILL AUS PTY LTD, Lake Illawarra (AU)

( * ) Notice: Subject to any disclaimer, the term of this patent is extended or adjusted under 35 U.S.C. 154(b) by 202 days.

(21) Appl. No.: 18/040,547

(22) PCT Filed: Aug. 5, 2021

(86) PCT No.: PCT/AU2021/050852
§ 371 (c)(1),
(2) Date: Feb. 3, 2023

(87) PCT Pub. No.: WO2022/036388
PCT Pub. Date: Feb. 24, 2022

(65) Prior Publication Data

US 2023/0304310 A1 Sep. 28, 2023

(30) Foreign Application Priority Data

Aug. 18, 2020 (AU) ..... 2020902932

(51) Int. Cl.
*E04G 15/06* (2006.01)
*E04G 11/08* (2006.01)

(52) U.S. Cl.
CPC ..... *E04G 15/065* (2013.01); *E04G 11/082* (2013.01)

(58) Field of Classification Search
CPC ... E04G 15/065; E04G 15/066; E04G 11/082; E04G 11/22
See application file for complete search history.

(56) References Cited

U.S. PATENT DOCUMENTS 3,476,351 A * 11/1969 Burdett ..... E04G 15/065 249/82
4,614,326 A 9/1986 Strickland et al.
5,230,907 A 7/1993 Strickland

FOREIGN PATENT DOCUMENTS

FR 2059864 A5 * 6/1971
IT MI20092357 A1 3/2010
(Continued)

OTHER PUBLICATIONS

Translation of FR-2059864-A5 (Year: 1971).*
(Continued)

*Primary Examiner* — John J DeRusso
(74) *Attorney, Agent, or Firm* — INNOVATION CAPITAL LAW GROUP, LLP; Vic Lin

(57) ABSTRACT

An inner form assembly for forming concrete building shafts has a quadrant of boards and corner posts therebetween. Each corner post has angled interface surfaces converging towards exposed orthogonal skin surfaces. The boards have respective angled interface surfaces meeting respective angled interface surfaces of the corner posts so that the boards are held orthogonally by the corner posts. The angled interface surfaces of the corner posts and the boards slidably bear against each other and mechanically interlock with catches sliding along slots so that the boards move in together to form a compacted cross section configuration when the corner posts rise with respect to the boards and the boards move out to form an expanded cross section configuration when the corner posts fall with respect to the boards and wherein the orthogonal skin surfaces come into alignment with respective skin surfaces of adjacent boards.

31 Claims, 3 Drawing Sheets

(56) References Cited

FOREIGN PATENT DOCUMENTS

| | | | |
|---|---|---|---|
| SU | 939694 | A1 | 6/1982 |
| SU | 1361276 | A2 | 12/1987 |

OTHER PUBLICATIONS

International Search Report & Written Opinion dated Sep. 20, 2021 from PCT Application No. PCT/AU2021/050852.
International-type search report dated Jan. 22, 2021 from PCT Application No. PCT/AU2021/050852.

* cited by examiner

COMPACTIBLE INNER FORM ASSEMBLY FOR FORMING CONCRETE BUILDING SHAFTS

FIELD OF THE INVENTION

This invention relates generally to formwork, and more particularly, this invention relates to a compactible inner form assembly for forming concrete building shafts.

BACKGROUND OF THE INVENTION

Concrete formwork used in the building industry form moulds for concrete for forming various building elements such as walls, columns, shafts and the like. After the concrete has set, the formwork is demounted, leaving the set concrete in place.

When forming tubular building elements, it is desirous to have compactible formwork of which a number of configurations include U.S. Pat. No. 5,230,907 A (STRICKLAND) 27 Jul. 1993 [hereinafter referred to as D1] for off-site prefabrication of tubular concrete segments which comprises horizontally acting hydraulic rams to pull in opposite corners to compact and inner mould assembly, U.S. Pat. No. 4,614,326 A (STRICKLAND) 30 Sep. 1986 [hereinafter referred to as D2] which similarly uses an arrangement of hydraulic rams and which is designed to form catch basins, SU 1361276 A2 (KAZAK PI ORGANIZATSII T STR KA) 23 Dec. 1987 [hereinafter referred to as D3], SU 939694 A1 (ALMA ATINSKIJ DOMOSTROITEL) 30 Jun. 1982 [hereinafter referred to as D4] which employ vertical moving corner elements to pull in side plates and IT M120092357 A1 (SETTEN GENESIO S P A) 31 Mar. 2010 [hereinafter referred to as D5] which uses pivot arms to pull in ramped edge corner pieces.

The present invention seeks to provide a collapsible formwork assembly to overcome problems associated when forming multi-floor building shafts which will overcome or substantially ameliorate at least some of the deficiencies of the prior art, or to at least provide an alternative.

It is to be understood that, if any prior art information is referred to herein, such reference does not constitute an admission that the information forms part of the common general knowledge in the art, in Australia or any other country.

SUMMARY OF THE DISCLOSURE

There is provided herein an inner form assembly for forming concrete building shafts which has a quadrant of boards and corner posts therebetween. Each corner post has angled interface surfaces converging towards exposed orthogonal skin surfaces. The boards have respective angled interface surfaces meeting respective angled interface surfaces of the corner posts so that the boards are held orthogonally by the corner posts. The angled interface surfaces of the corner posts and the boards slidably bear against each other so that the corner posts can travel vertically with respect to the boards and mechanically interlock with catches sliding along slots so that the boards move in together to form a compacted cross section configuration when the corner posts rise with respect to the boards and the boards move out to form an expanded cross section configuration when the corner posts fall with respect to the boards and wherein the orthogonal skin surfaces come into alignment with respective skin surfaces of adjacent boards.

The present form assembly may have particular geometry especially suited for forming multistorey shafts, such as lift shafts, stairwells and the like in situ unlike the off-site prefabrication cast assembly of D1, the catch basin forming apparatus of D2 or the relatively short arrangements taught by D3-D5.

In this regard, the inner form assembly may have a height of greater than 4 m so an entire floor shaft section may be formed at once and wherein the inner form assembly can be conveniently hoisted using crane between floors as the shaft is formed in stages.

Specifically, the present inner form assembly may comprise particular geometries to allow the relatively larger surface area boards to delaminate from the concrete and/or to provide sufficient clearance for hoisting of the form assembly up the shaft using the crane.

Specifically, the slots may have a height to horizontal extent ratio of greater than 5, preferably approximately 7 or more so as to leverage vertical crane force to horizontal force sufficient to delaminate the boards from the inner concrete surfaces of the shaft using the crane alone.

Furthermore, the exposed orthogonal skin surfaces of the corner posts may have a relatively small width as compared to those arrangements taught by D1 or D2 to minimise surface contact area to prevent the posts from sticking to the concrete when hoisted by the crane. In this regard, each orthogonal skin surface may have a width of less than 50 mm, preferably less than approximately 40 mm. Furthermore, the ratio of each corner post interface surface to that of a respective orthogonal skin surface may be greater than 4, preferably greater than 5, thereby allowing sufficient interfacing surfaces for the structural integrity of the assembly.

Furthermore, the ratio of a horizontal extent of each slot to a width of each orthogonal skin surface may be greater than 1 so that each corner post moves to a greater extent along a diagonal axis as compared to the extent to which each board moves along and orthogonal axis between the expanded and compacted cross-section configurations. Preferably, the ratio is greater than 1.5.

As such, the horizontal extent of each slot may be configured so that each board moves in by more than 30 mm, preferably approximately greater than 40 mm, thereby providing clearance of up to 80 mm along each axis of the form assembly. This is particularly useful as plywood nails may sometimes protrude by 25-30 mm from surfaces of the boards which would otherwise hinder the hoisting of the form assembly by the crane without this sufficient clearance.

Other aspects of the invention are also disclosed.

BRIEF DESCRIPTION OF THE DRAWINGS

Notwithstanding any other forms which may fall within the scope of the present invention, preferred embodiments of the disclosure will now be described, by way of example only, with reference to the accompanying drawings in which.

DESCRIPTION OF EMBODIMENTS

Figure 8:
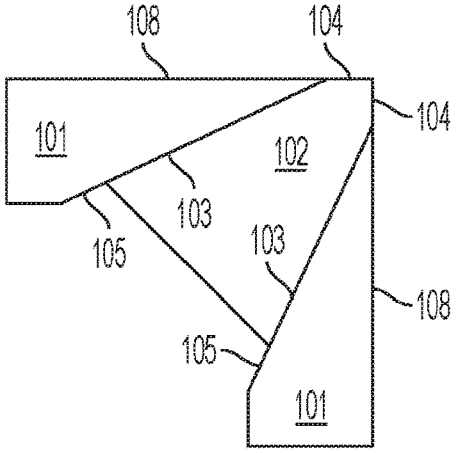
FIG. 8 shows a top plan view of the corner in the expanded configuration.
Figure 12:
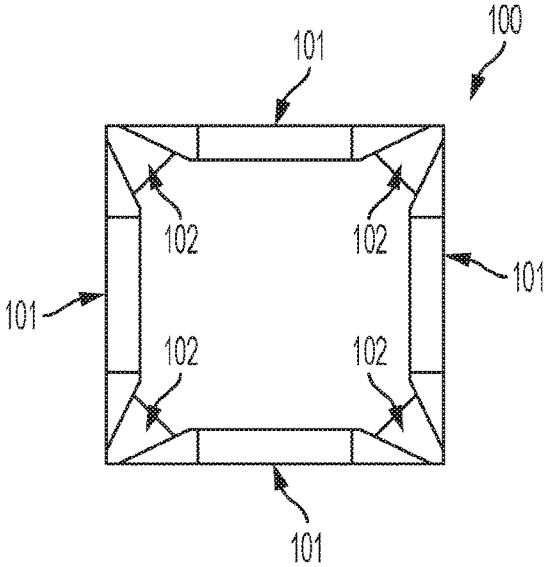
FIG. 12 shows a top plan view of the assembly in an expanded configuration.

With reference to FIG. 12, an inner form assembly 100 comprises a quadrant of boards 101 and corner posts 102. With reference to FIG. 8, each corner post 102 comprises angled interface surfaces 103 converging towards exposed orthogonal skin surfaces 104.

The boards 101 have angled interface surfaces 105 meeting respective angled interface surfaces 103 of the corner posts 102 so that the boards 101 are held orthogonally by the corner posts 102 in the manner shown in FIG. 12.

Figure 5:
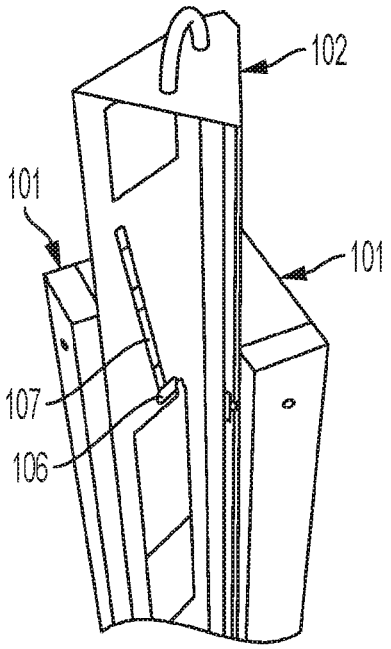
FIG. 5 shows a magnified in side view of the corner in the expanded configuration.
Figure 6:
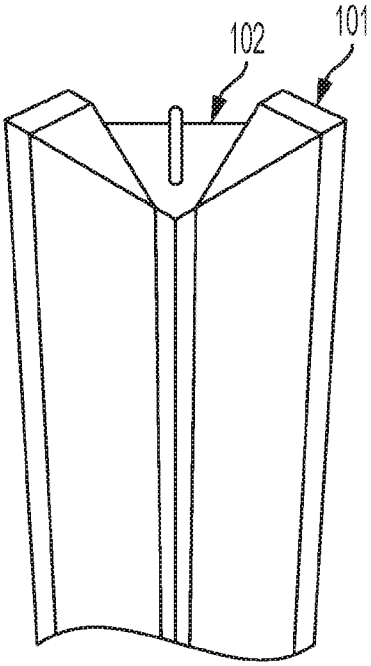
FIG. 6 shows a magnified outside view of the corner in the compacted configuration.
Figure 7:
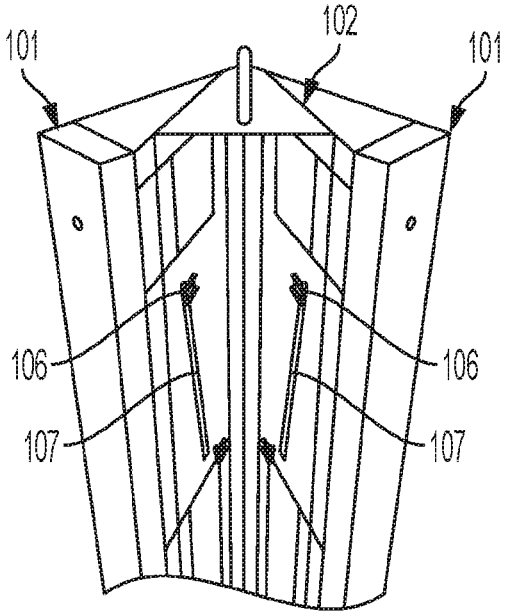
FIG. 7 shows a magnified in side view of the corner in the compacted configuration.

With reference to FIGS. 5 and 7, the angled interface surfaces 103, 105 slidably bear against each other so that each post 102 may rise vertically with respect to the adjacent boards 101 in the manner shown in FIG. 5 and fall vertically with respect to the adjacent boards 101 in the manner shown in FIG. 7.

Furthermore, the angled interface surfaces 103, 105 mechanically interlock with catches 106 sliding along slots 107. The slots 107 are angled outwardly towards upper end thereof. In embodiment shown in FIGS. 5 and 7, the slots 107 are arranged in pairs, each engaging a respective fastener 106 therethrough. Furthermore, with reference to FIG. 1, the slots 107 may be arranged along the length of the post 102. In the embodiment shown in FIG. 1, the post 102 comprises four pairs of slots 107.

Figure 9:
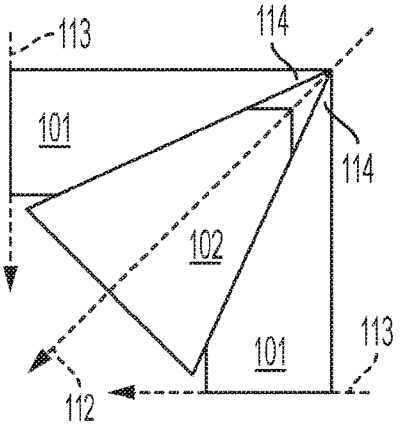
FIG. 9 shows a top plan view of the corner in a compacted configuration.
Figure 13:
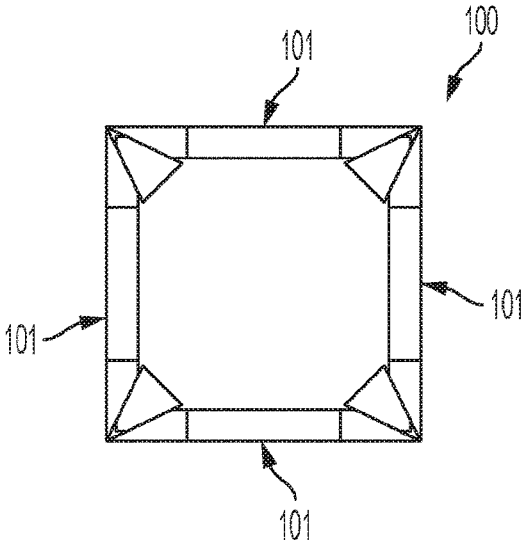
FIG. 13 shows a top plan view of the assembly in a compacted configuration.

The arrangements of the slots 107 and the catches allow the boards 101 to move in together to form a compacted cross-section configuration shown in FIGS. 9 and 13 when the corner posts 102 have risen with respect to the boards 101 in the manner shown in FIG. 5. Furthermore, the boards 101 move out to form an expanded cross-section configuration shown in FIGS. 8 and 12 when the corner posts 102 fall with respect to the boards 101 and wherein the orthogonal skin surfaces 104 come into alignment with respective skin surfaces 108 of the boards 101 in the manner shown in FIG. 8.

In the extended configuration, the orthogonal skin surfaces 104 are exposed.

Each post 102 may comprise a hoisting lug 109. In use, the hoisting lugs 109 may be attached by respective chains to a crane hook to pull up the posts 102 to allow the form assembly 100 to assume the compacted configuration.

Figure 1:
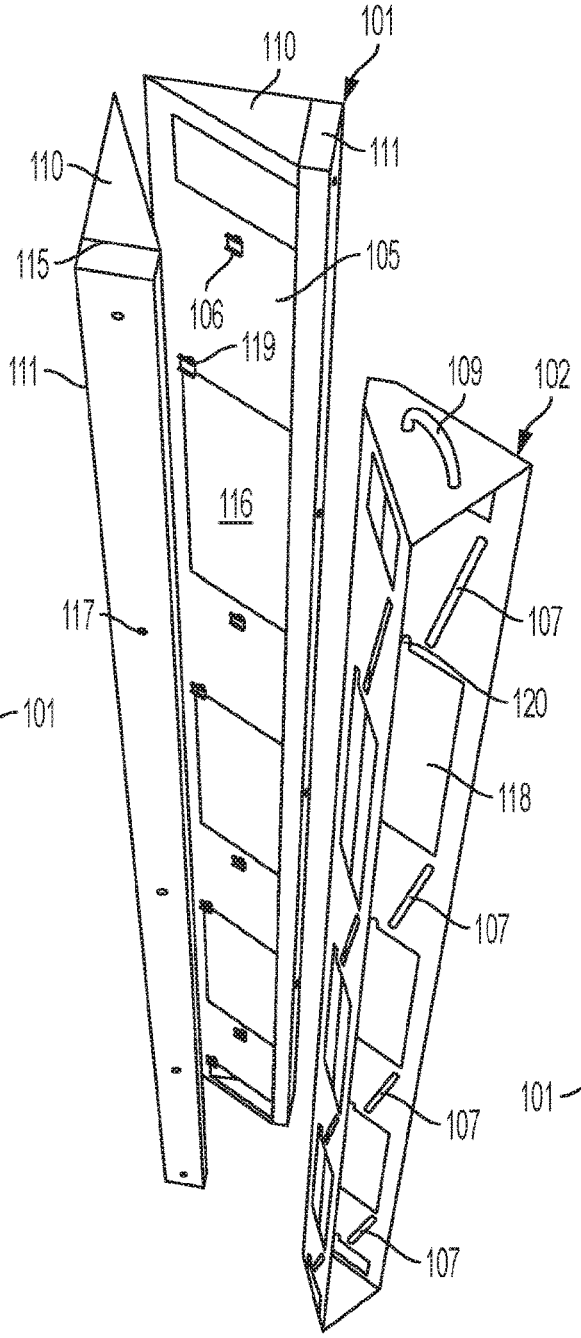
FIG. 1 shows an inside exploded representation of a corner of an inner form assembly in accordance with an embodiment.
Figure 2:
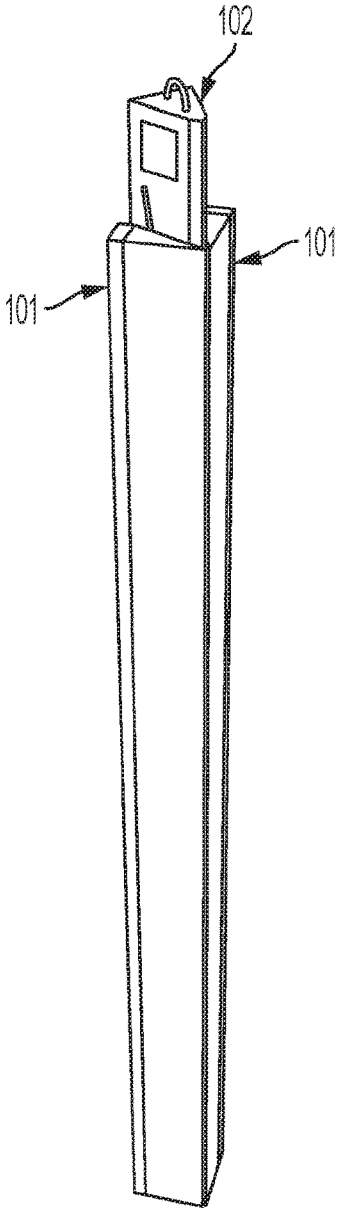
FIG. 2 shows an outside perspective view of the corner in an expanded configuration.
Figure 3:
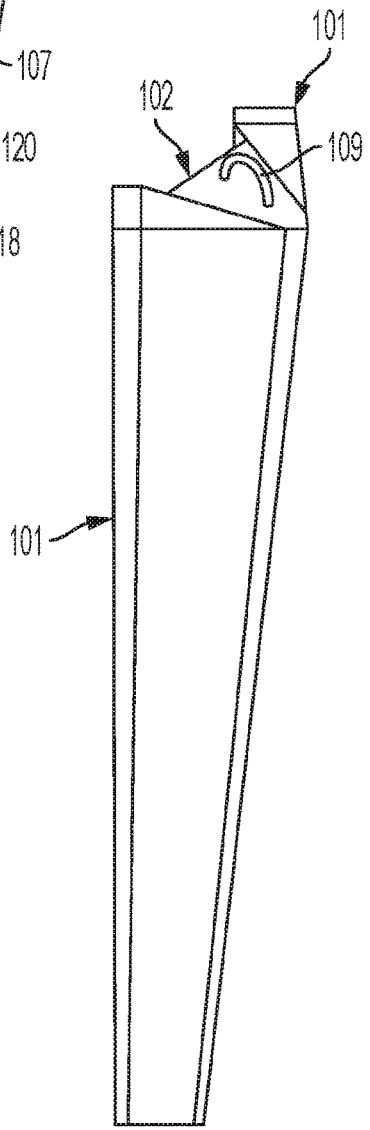
FIG. 3 shows an outside perspective view of the corner in a compacted configuration.
Figure 4:
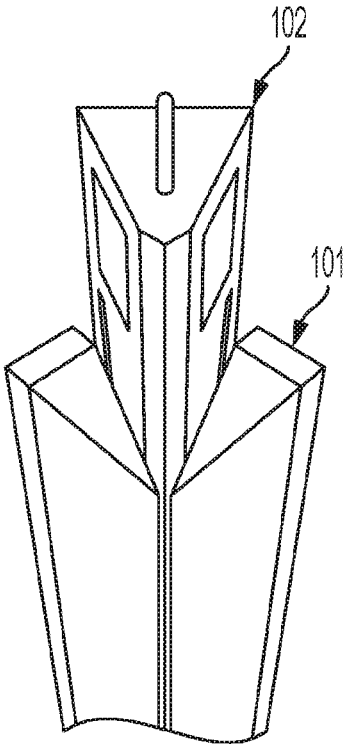
FIG. 4 shows a magnified outside view of the corner in the expanded configuration.

As shown in FIG. 1, each post 102 may be formed from metal plate to form the open channel piece shown in FIG. 1. Furthermore, the boards 101 may be formed by corresponding wedge pieces 110 which may be similarly formed from metal plate. The catches 106 may attach to the inner interface surfaces 105 of the metallic wedge pieces 110. Wooden battens 111 may be attached to orthogonal edges 115 of the wedge pieces 110 to which other componentry of the boards 101 may be attached. In this regard, the boards 101 may comprise timber panel work at 300 mm centres having 18 mm plywood face boards and held together using 3-inch nails.

The wedge pieces 110 may comprise windows 116 to allow access to a face of the batten 111 to drive wood screws 117 into the timber panel work. The corner post 102 may comprise corresponding windows 118.

The interface surfaces 103, 105 may comprise additional securing catches 119 which interconnect with corresponding notches 120 when the assembly 100 is in the expanded configuration so as to further brace and structurally support the assembly 100.

Each post 102 may have a height of greater than 4 m, preferably 4.5 m so as to allow for forming of shafts spanning entire floors.

This arrangement of metallic and wooden componentry confers structural resilience at the interworking corners of the assembly 101 yet exposes plywood skin surfaces better suited for delaminating from concrete.

Figure 11:
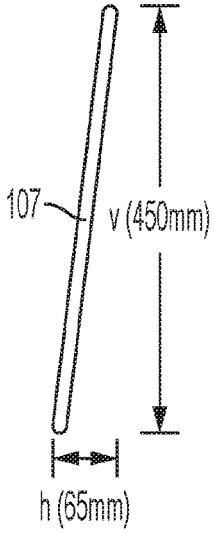
FIG. 11 shows a side elevation view of a slot of a corner post of the assembly.

With reference to FIG. 11, each slot 107 may comprise a vertical extent v and a horizontal extent h. The ratio of the vertical extent v to the horizontal extent h may be greater than 5, preferably greater than 7. In the embodiment shown, the vertical extent is approximately 450 mm whereas the horizontal extent is approximately 65 mm, thereby having a ratio of approximately 6.9.

This ratio leverages vertical force applied by the crane to sufficient horizontal force to delaminate the boards 101 from the concrete.

Figure 10:
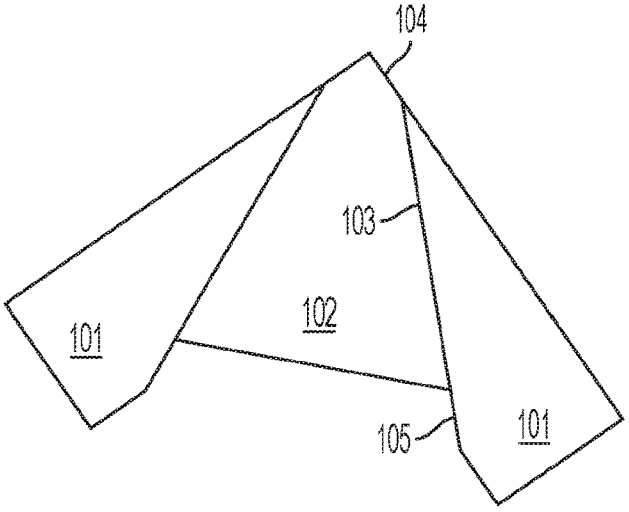
FIG. 10 gives exemplary dimensions of the corner.

With reference to the exemplary dimensions shown in FIG. 10, each orthogonal skin surface 104 may comprise a width of less than 50 mm, preferably less than approximately 40 mm. As such, the relatively narrow orthogonal skin surfaces 104 exposed less surface area in contact with the concrete when the assembly 100 is in the expanded configuration so as to allow delamination when the corner posts 102 are initially pulled upwardly by the crane in use.

As is further shown in FIG. 10, a ratio of a width of a corner post interface surface 103 to that of a respective orthogonal skin surface 104 may be greater than 4, preferably greater than 5. As such, the assembly 100 comprises sufficient interface surface contact area between the interface surfaces 103, 105 for structural integrity whilst exposing minimal skin surfaces 104.

Furthermore, the ratio of the horizontal extent h of each slot 107 to a width of each orthogonal skin surface 104 may be greater than 1 so that each corner post 102 moves to a greater extent along a diagonal axis 112 shown in FIG. 9 as compared to the extent to which each board 101 moves along and orthogonal axis 113 between the expanded and compacted cross-section configurations. The ratio is preferably greater than 1.5.

As such, the horizontal extent h of the slots 107 may be configured so that each board 101 moves along the orthogonal axis by more than 30 mm, preferably greater than approximately 40 mm, thereby providing a total clearance of 80 mm along each orthogonal axis 113. As such, the assembly 100 is able to be retrieved from the shaft having sufficient clearance to avoid any protruding nail heads or the like.

With reference to the embodiments of FIG. 11, with a horizontal extent of 65 mm, each corner post 102 would move along the diagonal axis 112 by 65 mm and the boards 102 may move along and orthogonal axis 113 defined by the width of each orthogonal skin surface 104, being 40 mm in this case. In the embodiments shown in FIG. 9, the apparatus 100 may be arranged so that distal tips 114 may come within 10 mm of each other or even make contact as shown in FIG. 9.

Forming a vertical building shaft using the apparatus 100 may comprise setting the apparatus 100 in place and erecting outer formwork therearound, thereby defining a rectangular mould therebetween into which reinforcement bar may be inserted.

Concrete may be poured into the mould and allowed to set.

Thereafter, a quadrant of chains may interconnect each lifting lug 107 of the corner posts 102 and attached to a crane hook. As the crane hook is pulled up, each post 102 is also pulled up. As alluded to above, the relatively small surface area of the expose orthogonal skin surfaces 104 allows the exposed surfaces of the corner post 102 to delaminate from the concrete so that the corner posts 102 do not stick when initially hoisted by the crane 102.

As further alluded to above, the angle ratio of the slots 107 may provide sufficient leverage to translate the lifting force applied by the crane to greater horizontal force sufficient to delaminate the boards 101 from the concrete.

In the compacted configuration shown in FIG. 13, the assembly 100 may have up to 80 mm of clearance along each orthogonal axis 113, thereby allowing the crane to lift the assembly to the next upper position without hindrance from any protrusions such as plywood nails.

At the next upper position, the corner post 102 may be lowered with respect to the boards so that the assembly 100 takes the expanded configuration shown in FIG. 12 and the process repeated.

As can be appreciated, this process avoids specialised hydraulic rams, screw jacks and the like, minimises human intervention and essentially allows the crane itself to hoist the assembly 100 quickly and simply upper each position as the shaft is formed incrementally.

The foregoing description, for purposes of explanation, used specific nomenclature to provide a thorough understanding of the invention. However, it will be apparent to one skilled in the art that specific details are not required in order to practise the invention. Thus, the foregoing descriptions of specific embodiments of the invention are presented for purposes of illustration and description. They are not intended to be exhaustive or to limit the invention to the precise forms disclosed as obviously many modifications and variations are possible in view of the above teachings. The embodiments were chosen and described in order to best explain the principles of the invention and its practical applications, thereby enabling others skilled in the art to best utilize the invention and various embodiments with various modifications as are suited to the particular use contemplated. It is intended that the following claims and their equivalents define the scope of the invention.

The term "approximately" or similar as used herein should be construed as being within 10% of the value stated unless otherwise indicated.

The invention claimed is:

1. An inner form assembly comprising:

a quadrant of boards; and corner posts between the boards, each corner post having:

angled interface surfaces converging towards exposed orthogonal skin surfaces, wherein:

the boards have angled interface surfaces meeting respective angled interface surfaces of the corner posts so that the boards are held orthogonally by the corner posts;

the angled interface surfaces of the corner posts and the boards slidably bear against each other and mechanically interlock with catches sliding along slots so that:

the boards move in together to form a compacted cross section configuration when the corner posts rise with respect to the boards; and the boards move out to form an expanded cross section configuration when the corner posts fall with respect to the boards and wherein the orthogonal skin surfaces come into alignment with respective skin surfaces of adjacent boards.

2. The assembly as claimed in claim 1, wherein each slot has a vertical extent to horizontal extent ratio of greater than 5.

3. The assembly as claimed in claim 2, wherein the assembly has a height of greater than 4 m.

4. The assembly as claimed in claim 3, wherein the ratio is approximately 7.

5. The assembly as claimed in claim 4, wherein the vertical extent is approximately 450 mm and the horizontal extent is approximately 65 mm.

6. The assembly as claimed in claim 1, wherein a ratio of a width of a corner post interface surface to that of a respective orthogonal skin surface is greater than 4.

7. The assembly as claimed in claim 6, wherein the ratio is greater than 5.

8. The assembly as claimed in claim 6, wherein each of the orthogonal skin surfaces comprises a width of less than 50 mm.

9. The assembly as claimed in claim 8, wherein the width of each of the orthogonal skin surfaces is less than approximately 40 mm.

10. The assembly as claimed in claim 1, wherein each of the orthogonal skin surfaces comprises a width of less than 50 mm.

11. The assembly as claimed in claim 10, wherein the width is less than approximately 40 mm.

12. The assembly as claimed in claim 1, wherein a ratio of a horizontal extent of each slot to a width of each orthogonal skin surface is greater than 1, so that each corner post moves to a greater extent along a diagonal axis as compared to an extent to which each board moves along an orthogonal axis between the expanded and compacted cross-section configurations.

13. The assembly as claimed in claim 12, wherein the ratio is greater than 1.5.

14. The assembly as claimed in claim 13, wherein each board moves along the orthogonal axis by more than 30 mm.

15. The assembly as claimed in claim 14, wherein each board moves along the orthogonal axis by greater than approximately 40 mm.

16. The assembly as claimed in claim 1, wherein each post comprises a hoisting lug, which in use, is attached to a crane to pull up the posts to allow the form assembly to assume the compacted configuration.

17. The assembly as claimed in claim 1, wherein each post is formed from metal plate to form an open channel piece.

18. The assembly as claimed in claim 1, wherein the boards comprise wedge pieces.

19. The assembly as claimed in claim 18, wherein the wedge pieces are formed from metal plate.

20. The assembly as claimed in claim 18, wherein the catches attach to inner interface surfaces of the wedge pieces.

21. The assembly as claimed in claim 18, wherein wooden battens attach to orthogonal edges of the wedge pieces.

22. The assembly as claimed in claim 21, wherein timber panel work is attached to the battens.

23. The assembly as claimed in claim 22, wherein the wedge pieces comprise cutouts to allow access to a face of the batten to drive wood screws into the timber panel work.

24. The assembly as claimed in claim 23, wherein each corner post comprises windows corresponding to the cutouts of the wedge pieces.

25. The assembly as claimed in claim 1, wherein the angled interface surfaces of the posts or of the boards comprise additional securing catches which interconnect with corresponding notches when the assembly is in the expanded configuration.

26. The assembly as claimed in claim 1, wherein the slots are arranged so that distal tips come within 10 mm of each other in the compacted configuration.

27. A method of using the assembly of claim 1, comprising setting the assembly in place and erecting outer formwork therearound, thereby defining a rectangular mould therebetween and pouring concrete therein which is allowed to set whereafter the corner posts are pulled up by a crane so that the assembly takes on the compacted configuration so that the assembly can be hoisted to a next upper position.

28. The method as claimed in claim 27, wherein, at the next upper position, the corner posts are lowered with respect to the boards so that the assembly takes the expanded configuration.

29. The method as claimed in claim 27, wherein the assembly has a height of greater than 4 m and wherein each of the orthogonal skin surfaces comprises a width of less than 50 mm.

30. The method as claimed in claim 27, wherein the assembly has a height of greater than 4 m and wherein the slots have a vertical extent to horizontal extent ratio of greater than 5.

31. The method as claimed in claim 27, wherein the assembly has a height of greater than 4 m and wherein the ratio of a horizontal extent of each slot to a width of each orthogonal skin surface is greater than 1, so that each corner post moves to a greater extent along a diagonal axis as compared to the extent to which each board moves along an orthogonal axis between the expanded and compacted cross-section configurations and wherein each board moves along the orthogonal axis by more than 30 mm.

* * * * *